US007275910B2

(12) United States Patent
Chang et al.

(10) Patent No.: US 7,275,910 B2
(45) Date of Patent: Oct. 2, 2007

(54) OUTLET AIRFLOW DIRECTION CONTROL UNIT

(75) Inventors: Bor-Haw Chang, Taipei Hsien (TW); Wen-Hao Liu, Taipei Hsien (TW)

(73) Assignee: Asia Vital Components Co., Ltd. (TW)

( * ) Notice: Subject to any disclaimer, the term of this patent is extended or adjusted under 35 U.S.C. 154(b) by 0 days.

(21) Appl. No.: 10/606,739

(22) Filed: Jun. 27, 2003

(65) Prior Publication Data

US 2004/0265123 A1 Dec. 30, 2004

(51) Int. Cl.
*F04D 29/54* (2006.01)

(52) U.S. Cl. ..... 415/211.2; 415/220

(58) Field of Classification Search ..... 415/191, 415/208.2, 211.2, 185, 193, 220
See application file for complete search history.

(56) References Cited

U.S. PATENT DOCUMENTS 16,547 A * 2/1857 Marshall ..... 415/208.2
2,298,576 A * 10/1942 McElroy et al. ..... 415/191
3,221,662 A * 12/1965 White ..... 415/119
3,883,264 A * 5/1975 Rao ..... 415/119
3,924,964 A * 12/1975 Lievens et al. ..... 415/208.2
3,976,393 A * 8/1976 Larson ..... 415/208.2
3,995,970 A * 12/1976 Nobuyuki ..... 415/208.2
4,895,489 A * 1/1990 Kohama et al. ..... 415/218.1
6,045,327 A * 4/2000 Amr ..... 415/211.2
6,142,733 A * 11/2000 Alizadeh et al. ..... 415/211.2
6,406,258 B1 * 6/2002 Lin et al. ..... 415/208.5
6,547,540 B1 * 4/2003 Horng et al. ..... 415/211.2

FOREIGN PATENT DOCUMENTS

JP 57-186098 * 11/1982 ..... 415/211.1

* cited by examiner

*Primary Examiner*—Theresa Trieu
(74) *Attorney, Agent, or Firm*—Bacon & Thomas PLLC

(57) ABSTRACT

An outlet airflow direction control unit mainly includes a frame and a fan mounted in the frame. The frame has an inlet and an outlet via which an amount of fluid flows into and out of the frame, and is internally provided at predetermined positions with a plurality of radially projected fluid control elements. When the fan is rotated to cause an amount of fluid to flow through the outlet of the frame, the fluid control elements provided in the frame are adapted to control a flow direction of the fluid flown out of the outlet.

4 Claims, 9 Drawing Sheets

OUTLET AIRFLOW DIRECTION CONTROL UNIT

FIELD OF THE INVENTION

The present invention relates to an outlet airflow direction control unit, which includes a frame, a fan mounted in the frame, and a plurality of radially projected fluid control elements provided at predetermined positions in the frame.

BACKGROUND OF THE INVENTION

Most currently developed electronic products have powerful functions and constantly increased working frequency and operating speed. The higher the working frequency is, the more heat is produced during the operation of the electronic products. The electronic products tend to become unstable when they operate under a high-temperature state. Therefore, it has become an important issue to effectively and quickly remove waste heat from the electronic products to reduce an internal temperature thereof, so that the electronic products could operate under an optimal working temperature. The use of a fan is one of many economical ways to effectively remove heat from the operating electronic products. When a motor of the fan is actuated to rotate blades of the fan, electric energy is converted into mechanical energy, which is transferred via the blades to cause flowing of air and thereby achieve the purpose of carrying away heat produced by the electronic products during operation.

Generally, when an amount of fluid is driven by the rotating blades of the fan to flow through an outlet of the fan, the fluid tends to diffuse toward outer areas surrounding the fan, so that a relatively large dead-air zone is formed behind a hub of the fan to degrade the cooling effect of the fan. When the conventional fan is mounted at a location having poor air ventilation and high impedance to dissipate heat produced by an electronic element, the dead-air zone behind the hub of the fan actually largely reduces the radiation effect that may be achieved by the fan, resulting in damaged electronic elements due to high temperature produced during working of the electronic elements.

U.S. Pat. No. 6,524,067 discloses a device that guides a flow direction by concentrating air flown through the device. The flow-guiding device may be mounted on a heat-producing element to dissipate heat produced by the element during operation thereof. The flow-guiding device mainly includes a frame, an air inlet provided on the frame for guiding an amount of air into the frame, and an air outlet provided on the frame to contact with the heat-producing element. The air outlet has an inner diameter smaller than that of the air inlet, so that airflow flown to the air outlet is concentrated and blown to the heat-producing element to reduce the temperature thereof.

The frame of the above-described flow-guiding device having an air outlet diametrically larger than an air inlet has a tapered inner bore adapted to concentrate the air flown toward the air outlet. However, the air outlet having a reduced area also results in an increased air speed and decreased air pressure, as well as increased noise at the air outlet.

Taiwanese New Utility Model Patent Application No. 091208045 entitled "Radiating device and flow-guiding means thereof" discloses a flow-guiding means that is connected to a fan and a radiating fin to form a radiating device for carrying away heat produced by an electronic apparatus. The radiating fin is in contact with the electronic apparatus to absorb heat energy produced by the electronic apparatus. The flow-guiding means includes a flow-guiding tube and a plurality of flow-guiding plates. The flow-guiding tube is mounted between the fan and the radiating fin, and includes a front and a rear opening. The front opening has an area larger than that of the rear opening. The flow-guiding plates are circumferentially spaced in the flow-guiding tube. When the fan is rotated, air is sucked into the flow-guiding tube via the front opening to pass the flow-guiding plates and flows out of the tube via the rear opening to dissipate heat absorbed by the radiating fin and therefore indirectly reduces the heat energy produced by the electronic apparatus.

In the above-described combination of the radiating device with the flow-guiding means, the fan would produce noise when it rotates. Moreover, the rotating fan also produces vibration that further vibrates the flow-guiding means connected to the fan and the radiating fin connected to the flow-guiding means, no matter how tightly these parts are assembled together, resulting in multiple noise sources. In addition, the front opening of the flow-guiding tube has an area larger than that of the rear opening, giving the flow-guiding tube a tapered configuration. As a result, noise is produced when air flows through the tapered flow-guiding tube. Another disadvantage of the above-described radiating device is increased fabricating and material costs due to assembling of the flow-guiding means to the fan and the flow-guiding tube, making the assembly not economical for use.

It is therefore tried by the inventor to develop an outlet airflow direction control unit to eliminate drawbacks existed in the conventional flow-guiding means.

SUMMARY OF THE INVENTION

A primary object of the present invention is to provide an outlet airflow direction control unit that uses fluid control elements to produce a relative large radial pressure against the fluid flown through the unit, so as to control the flow direction of the fluid.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
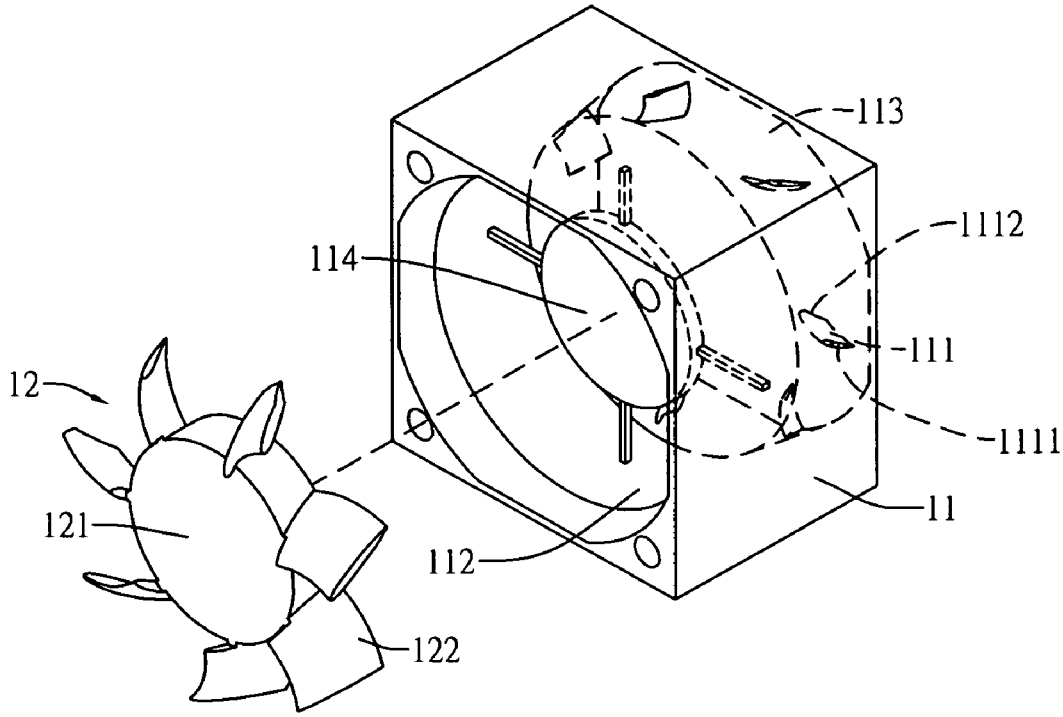
FIG. 1 is a front exploded perspective view of an outlet airflow direction control unit according to a first embodiment of the present invention.
Figure 2:
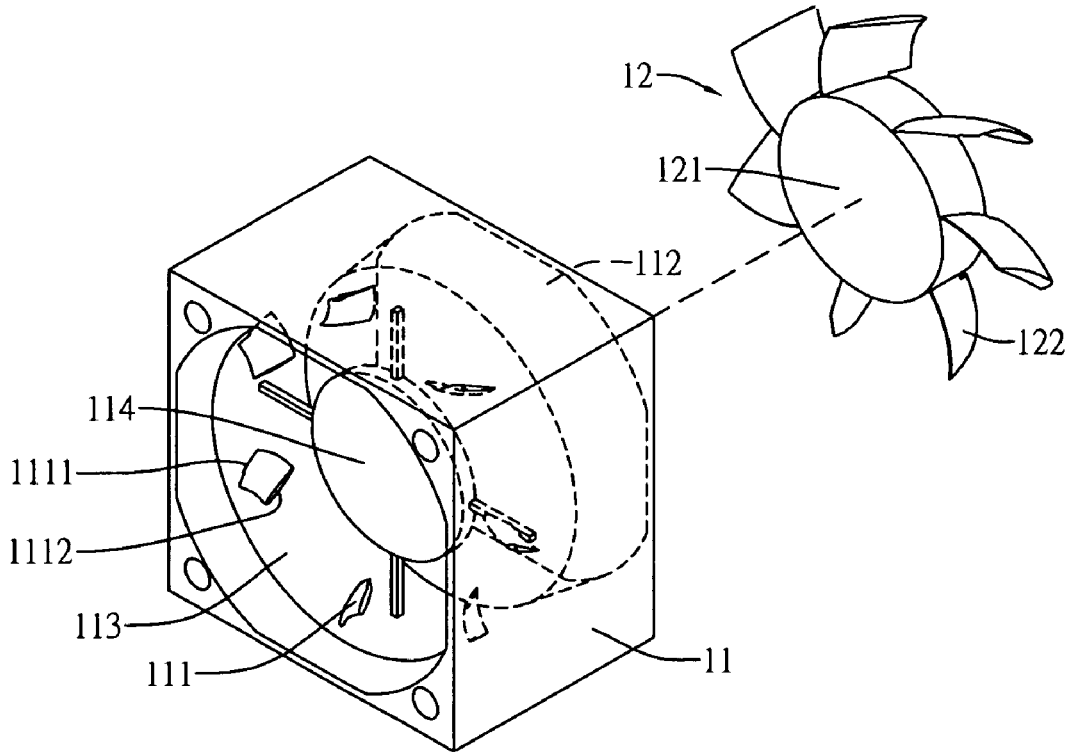
FIG. 2 is a rear exploded perspective view of the outlet airflow direction control unit of FIG. 1.
Figure 3:
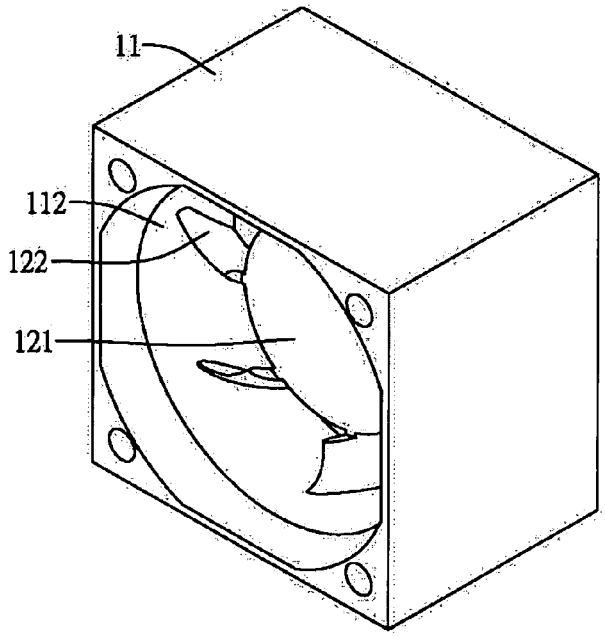
FIG. 3 is a front assembled perspective view of the outlet airflow direction control unit of FIG. 1.

Please refer to FIGS. 1, 2, and 3, in which an outlet airflow direction control unit according to a first embodiment of the present invention is shown. As shown, the outlet airflow direction control unit mainly includes a frame 11 and a fan 12. The fan 12 includes a hub 121 and a plurality of blades 122. The frame 11 is internally provided with a supporting member 114 to support the fan 12 thereon. The frame 11 has an inner peripheral wall that defines an air passageway having an inlet 112 and an outlet 113 via which an amount of fluid flows into and out of the frame 11. A plurality of radially projected fluid control elements (blades 111) are fixed to the peripheral wall near the outlet, each fluid control element having an outer edge 1111 fixed to said peripheral wall and a free inner edge 1112, each control blade having a radius of curvature, adapted to change a radial pressure against the fluid flowing through the frame 11, so that the fluid at the outlet 113 flows radially inward without quickly diffusing outward. Therefore, directions in which the fluid at the outlet 113 flows may be controlled and a noise produced by the fluid flowing through the outlet 113 is reduced.

Figure 4:
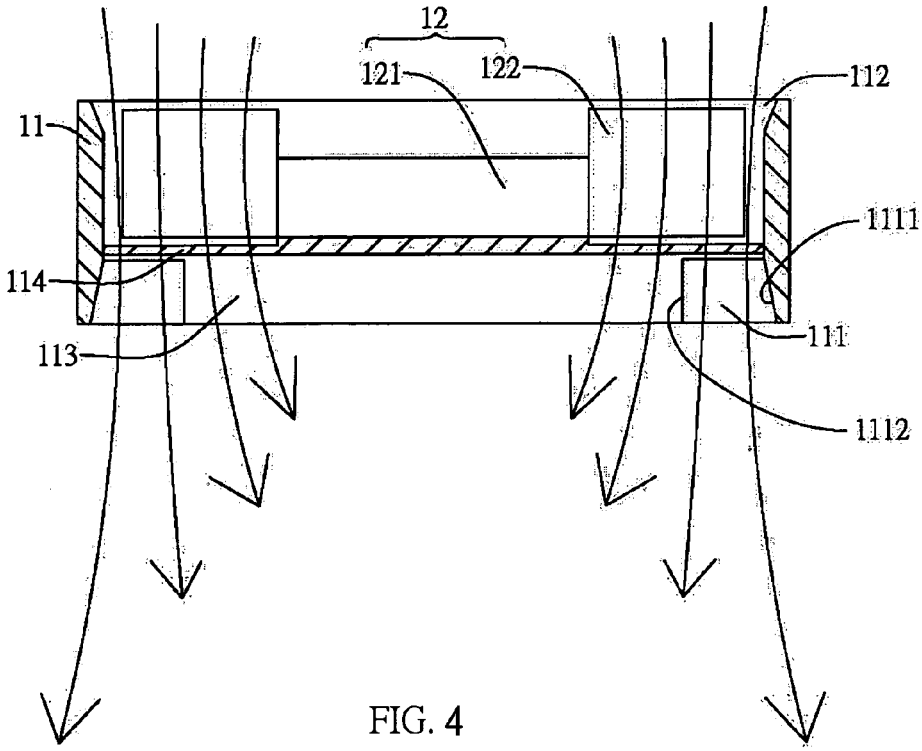
FIG. 4 is a cross sectional view of the outlet airflow direction control unit of FIG. 1 showing airflow directions at an outlet of the unit.

Please refer to FIG. 4. When the blades 122 of the fan 12 are rotated, a non-constant flow field is produced to cause the fluid to flow into the frame 11 via the inlet 112 and out of the frame 11 via the outlet 113. When the fluid flows through the outlet 113, it is affected by the radially projected control blades 111 and is subject to a relatively large radial pressure to therefore flow toward a center behind the hub 121 of the fan 12. That is, there is an increased amount of the fluid flown to a rear side of the hub 121 to reduce a dead-air zone behind the hub 121. Therefore, the outlet airflow direction control unit of the present invention may be used to carry heat produced in a system to external environments at a largely upgraded radiation efficiency to provide an enhanced radiation effect.

Figure 5:
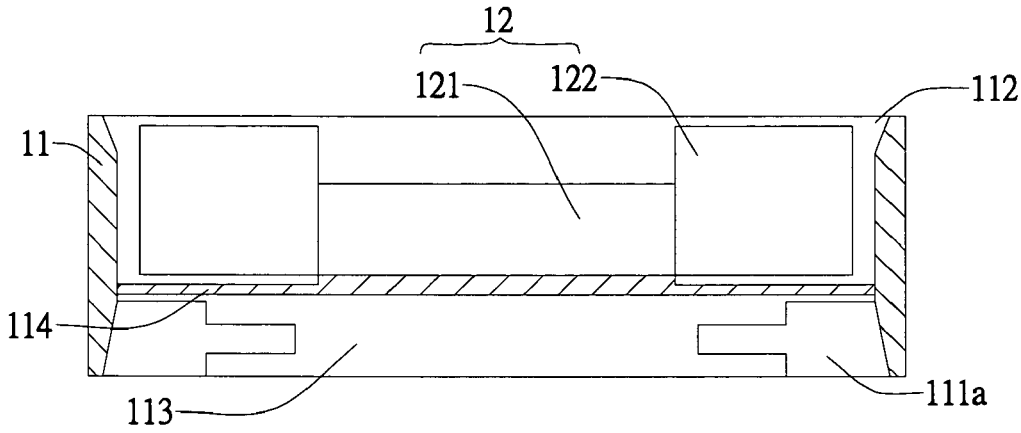
FIG. 5 shows a variant of the control blade included in the first embodiment of the present invention.
Figure 6:
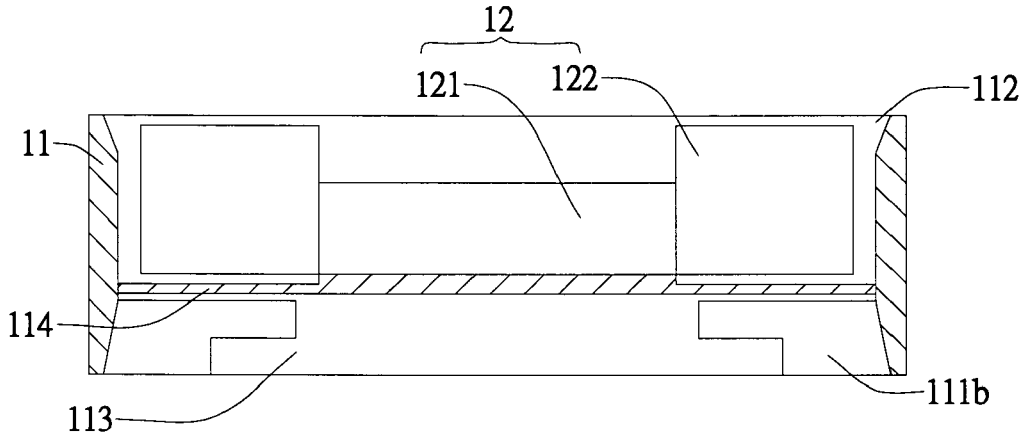
FIG. 6 shows another variant of the control blade included in the first embodiment of the present invention.
Figure 7:
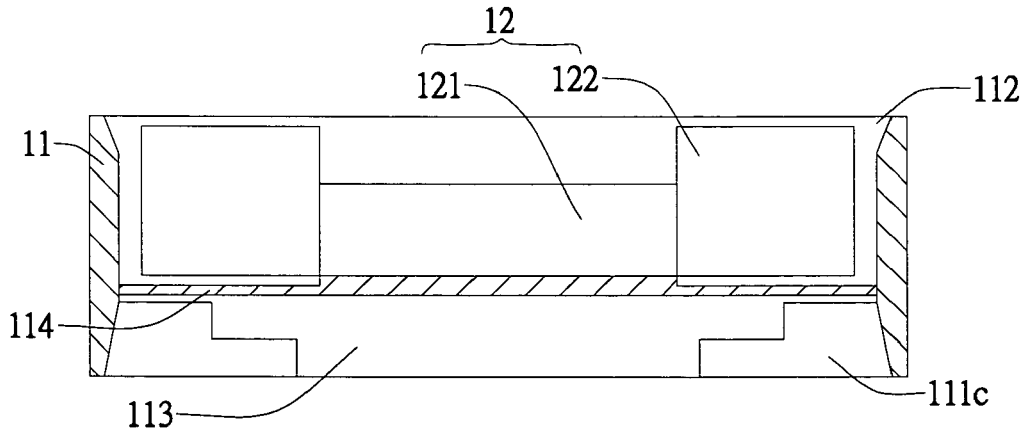
FIG. 7 shows a further variant of the control blade included in the first embodiment of the present invention.
Figure 8:
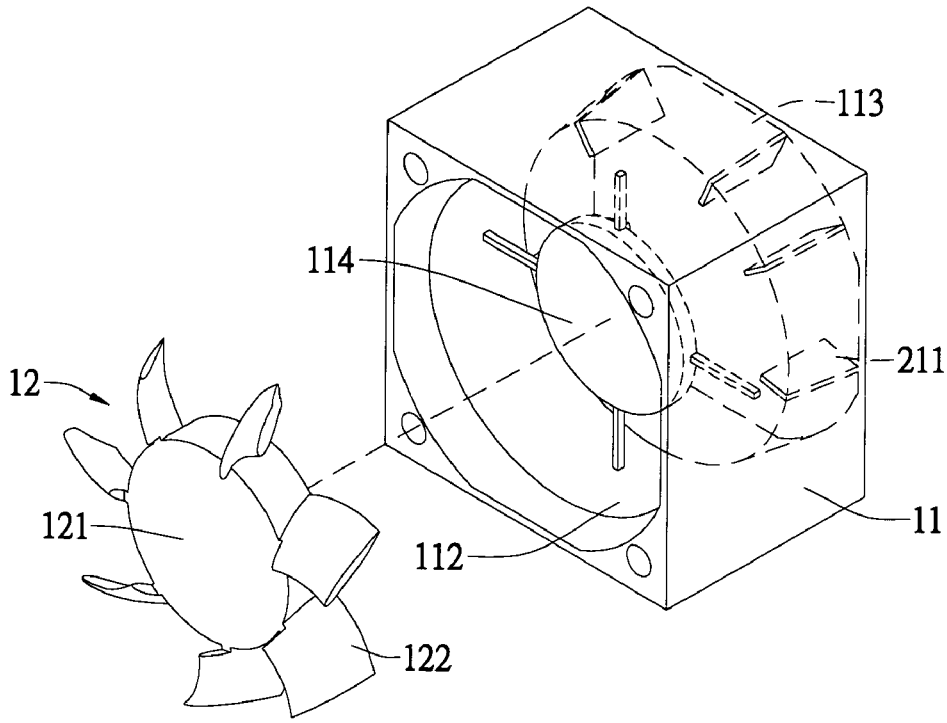
FIG. 8 is a front exploded perspective view of an outlet airflow direction control unit according to a second embodiment of the present invention.
Figure 9:
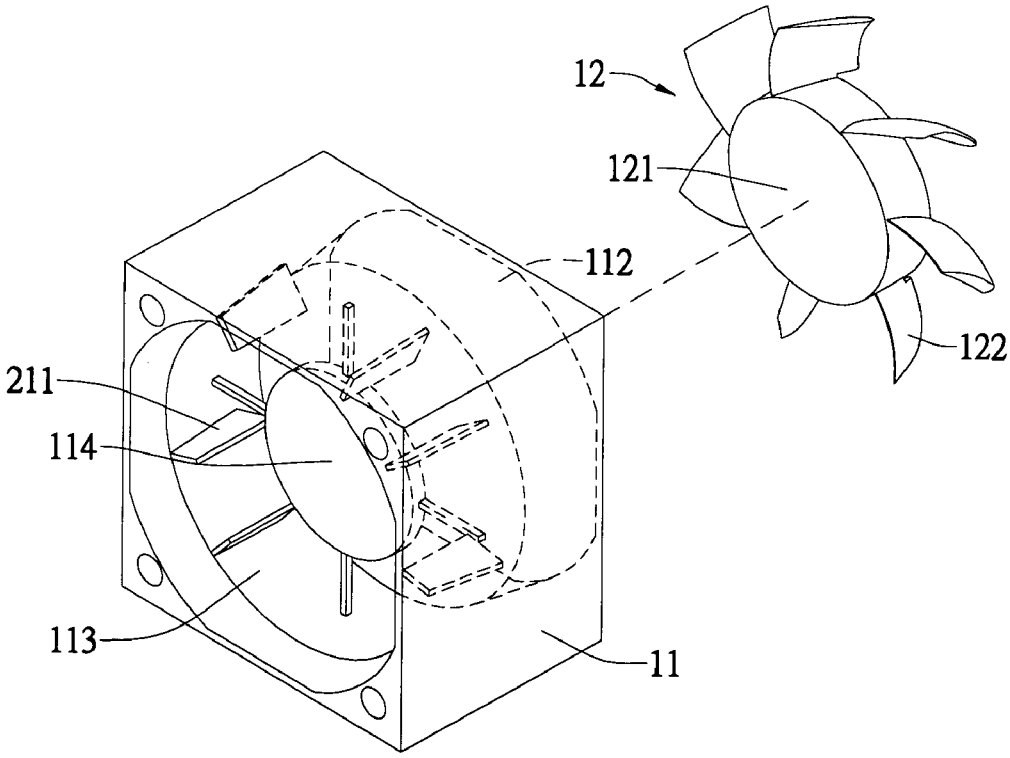
FIG. 9 is a rear exploded perspective view of the outlet airflow direction control unit of FIG. 8.
Figure 10:
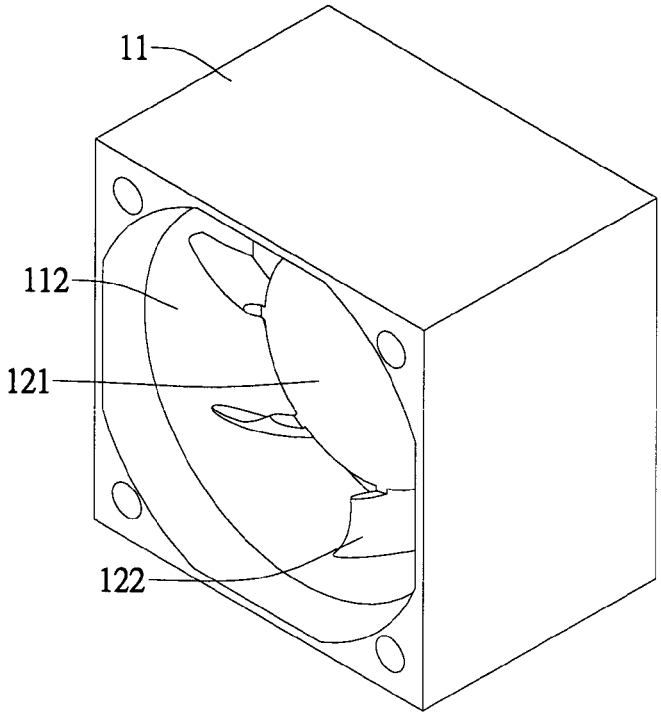
FIG. 10 is a front assembled perspective view of the outlet airflow direction control unit of FIG. 8.
Figure 11:
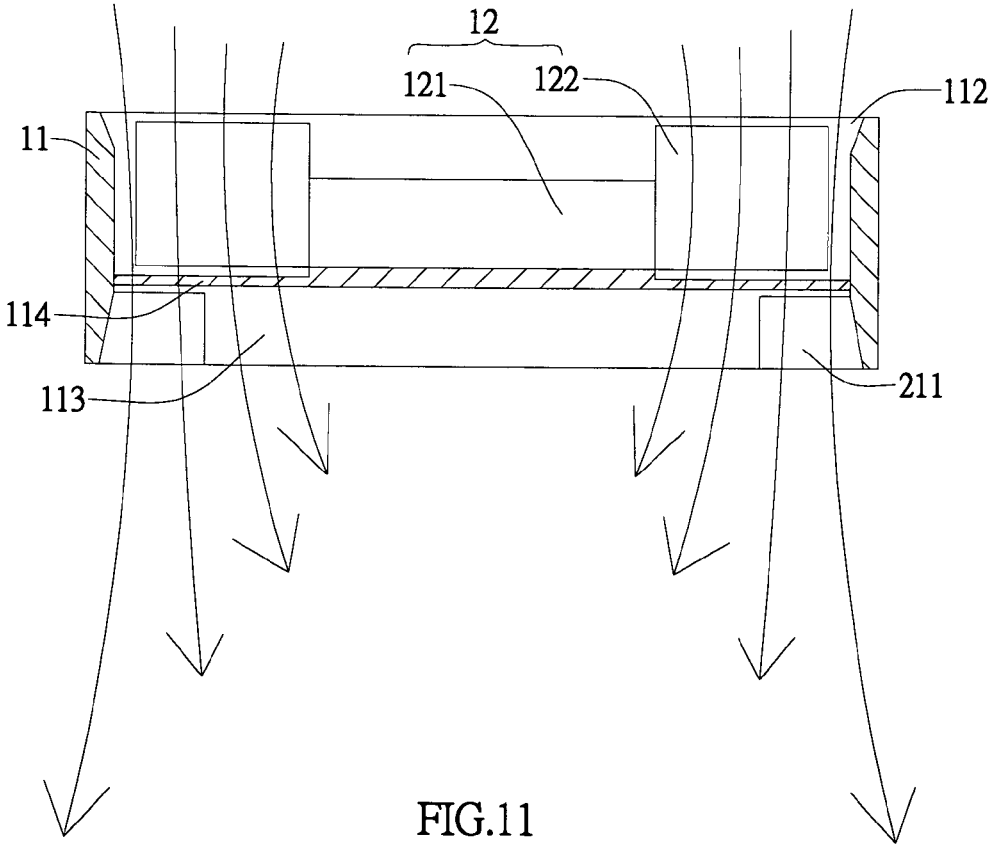
FIG. 11 is a cross sectional view of the outlet airflow direction control unit of FIG. 8 showing airflow directions at an outlet of the unit.

Please refer to FIGS. 4, 5, 6, and 7. The control blade 111 for the present invention may be differently configured, such as T-shaped, reverse L-shaped, and L-shaped control blade 111*a*, 111*b*, and 111*c*, as shown in FIGS. 5, 6, and 7, respectively. All the above three types of control blades are adapted to change the radial pressure against the fluid passing through the outlet 113 to achieve the effect of controlling the flow direction of the fluid and producing enhanced radiating power.

Please refer to FIGS. 8 to 11 in which an outlet airflow direction control unit according to a second embodiment of the present invention is shown. As shown, the second embodiment is structurally and functionally similar to the first embodiment, except that the outlet 113 of the frame 11 of the second embodiment is formed on a peripheral wall thereof with a plurality of radially projected ribs 211 to change the radial pressure against the fluid flowing through the frame 11 and thereby control the flow direction of the fluid at the outlet 113.

Figure 12:
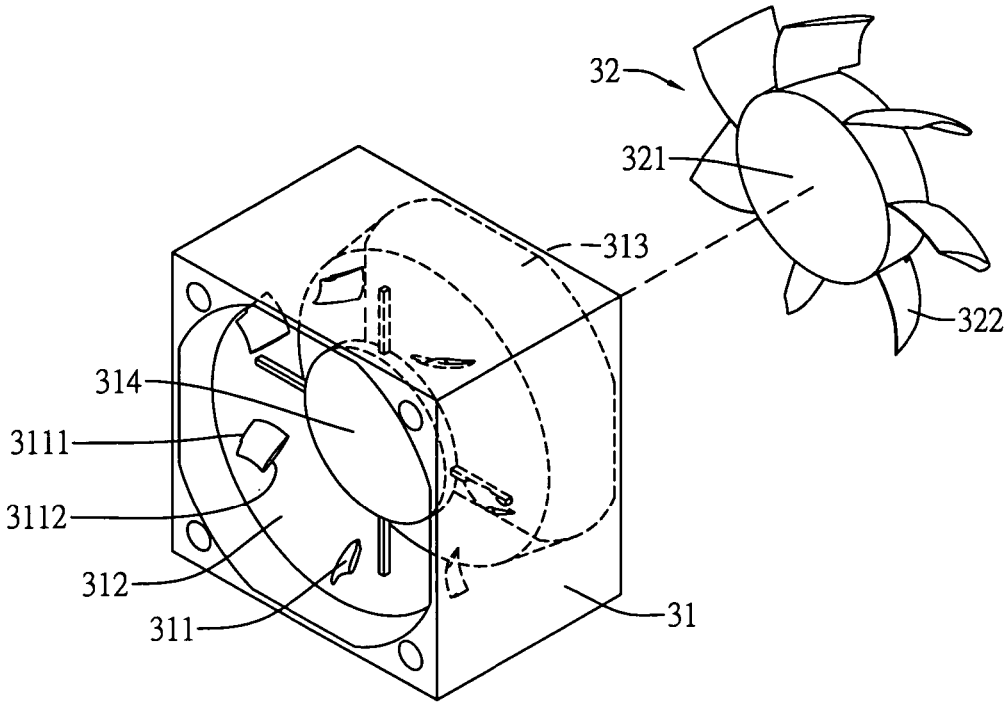
FIG. 12 is a front exploded perspective view of an outlet airflow direction control unit according to a third embodiment of the present invention.
Figure 13:
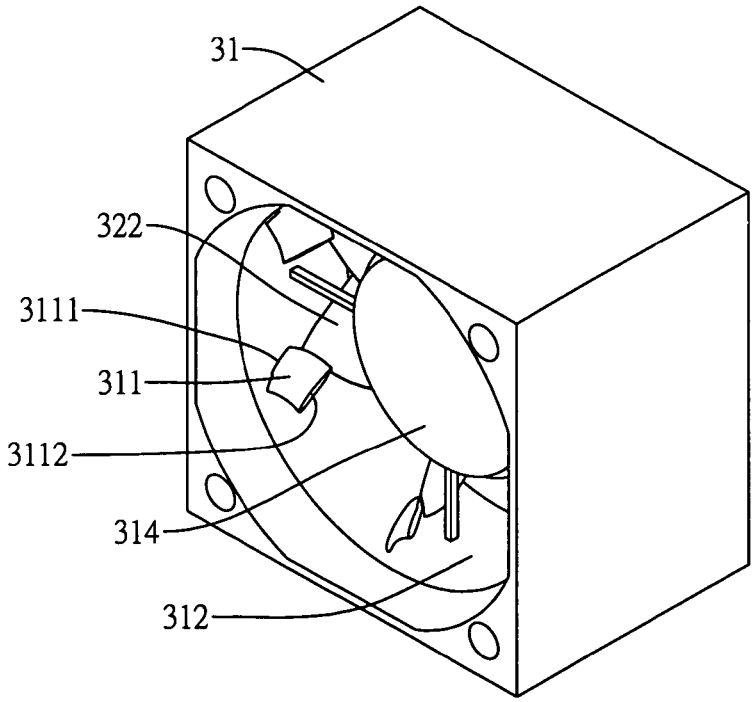
FIG. 13 is a front assembled perspective view of the outlet airflow direction control unit of FIG. 12.

FIGS. 12 and 13 are exploded and assembled perspective views, respectively, of an outlet airflow direction control unit according to a third embodiment of the present invention is shown. As shown, the outlet airflow direction control unit according to the third embodiment mainly includes a frame 31, and a fan 32. The fan 32 includes a hub 321 and a plurality of blades 322. The frame 31 is internally provided with a supporting member 314 to support the fan 32 thereon. The frame 31 is internally provided with a supporting member 314 to support the fan 32 thereon. The frame 31 has an inner peripheral wall that defines an air passageway having an inlet 312 and an outlet 313 via which an amount of fluid flows into and out of the frame 31. A plurality of radially projected control elements (blades) 311 are fixed to the peripheral wall near the inlet 312, each fluid control element having an outer edge 3111 fixed to said peripheral wall and a free inner edge 3112, each control blade having a radius of curvature, adapted to change a radial pressure against the fluid flowing through the frame 31, so that the fluid at the outlet 313 flows radially inward without quickly diffusing outward. Therefore, a direction in which the fluid at the outlet 313 flows may be controlled and a noise produced by the fluid flowing through the outlet 313 is reduced.

Figure 14:
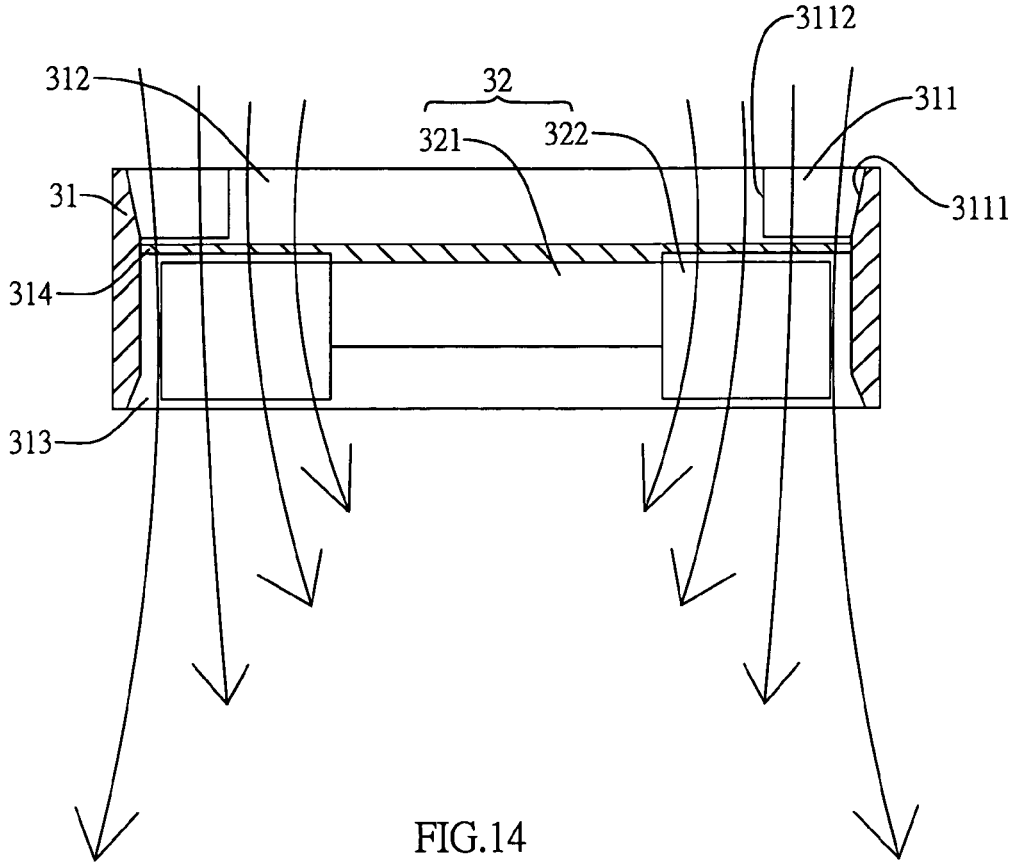
FIG. 14 is a cross sectional view of the outlet airflow direction control unit of FIG. 12 showing airflow directions at an outlet of the unit.

Please refer to FIG. 14. When the blades 322 of the fan 32 are rotated, a non-constant flow field is produced to cause the fluid to flow into the frame 31 via the inlet 312 and out of the frame 31 via the outlet 313. When the fluid flows through the inlet 312, it is affected by the radially projected control blades 311 and is subject to a relatively large radial pressure to therefore flow toward the hub 321 of the fan 32. And, when the fluid is brought by the rotating blades 322 to flow through the outlet 313, the fluid also flows toward a center behind the hub 321. That is, there is an increased amount of the fluid flown to a rear side of the hub 321 to reduce a dead-air zone behind the hub 321. Therefore, the outlet airflow direction control unit of the present invention may be used to carry heat produced in a system to external environments at a largely upgraded radiation efficiency to provide an enhanced radiation effect.

Figure 15:
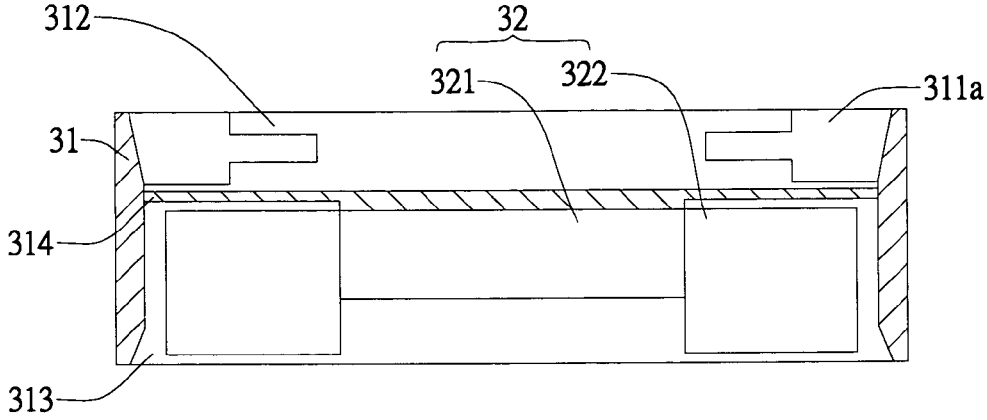
FIG. 15 shows a variant of the control blade included in the third embodiment of the present invention.
Figure 16:
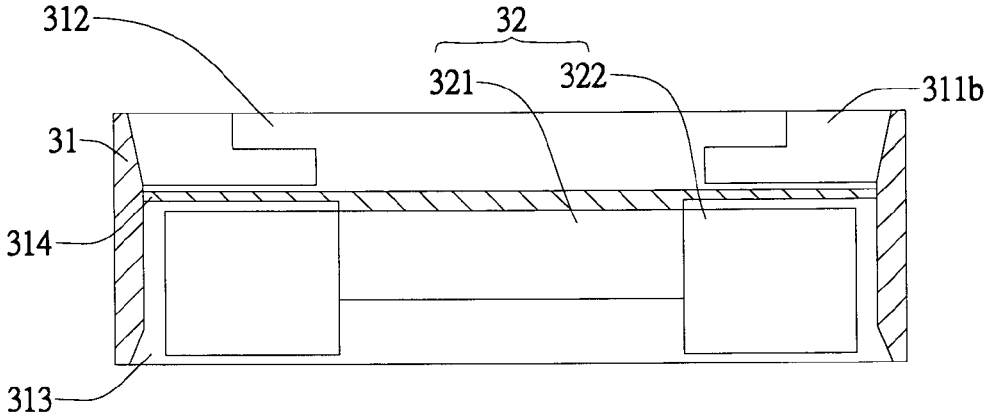
FIG. 16 shows another variant of the control blade included in the third embodiment of the present invention.
Figure 17:
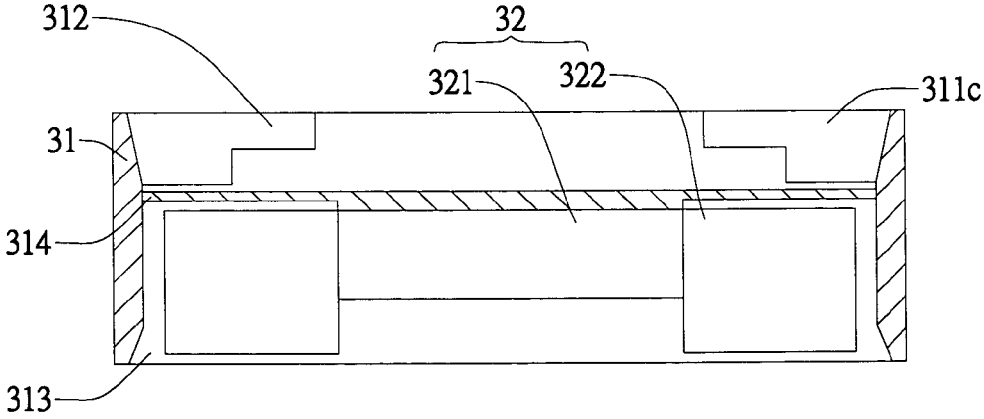
FIG. 17 shows a further variant of the control blade included in the third embodiment of the present invention.

Please refer to FIGS. 14, 15, 16, and 17. The control blade 311 for the present invention may be differently configured, such as T-shaped, reverse L-shaped, and L-shaped control blade 311*a*, 311*b*, and 311*c*, as shown in FIGS. 15, 16, and 17, respectively. All the above three types of control blades are adapted to change the radial pressure against the fluid passing through the outlet 313 to achieve the effect of controlling the flow direction of the fluid and producing enhanced radiating power.

Figure 20:
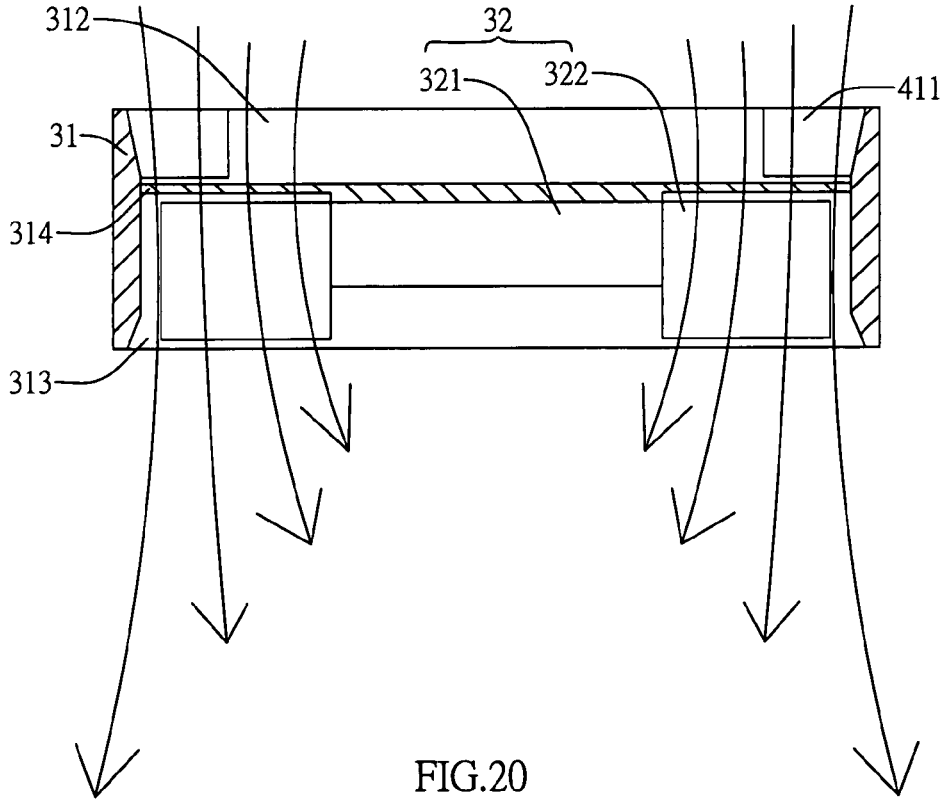
FIG. 20 is a cross sectional view of the outlet airflow direction control unit of FIG. 18 showing airflow directions at an outlet of the unit.
Figure 18:
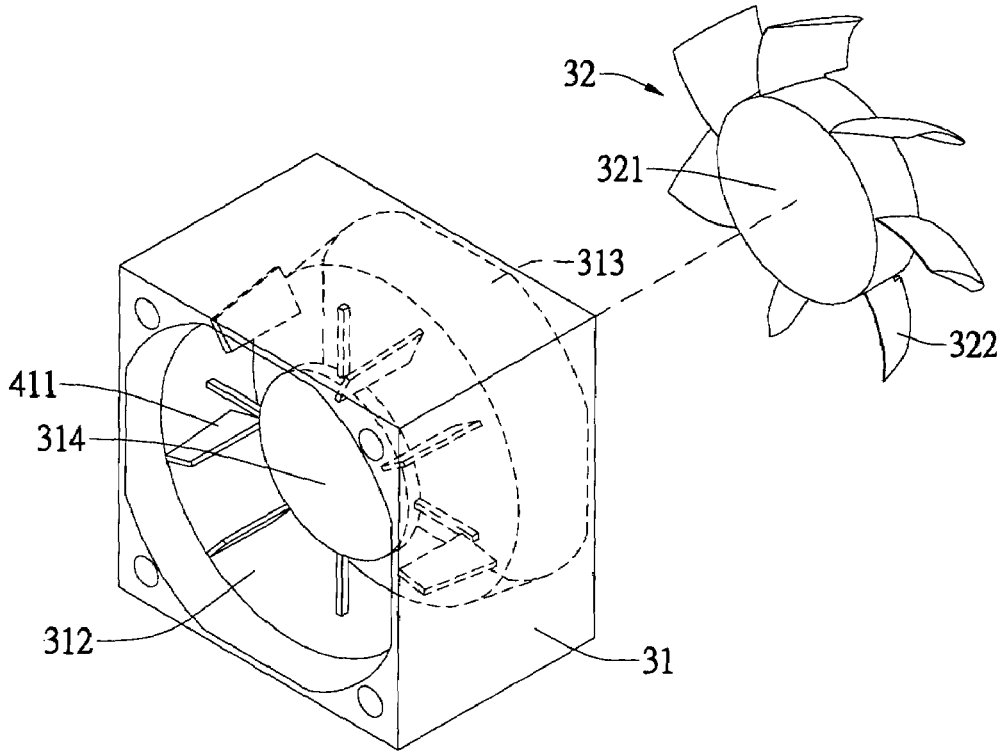
FIG. 18 is a front exploded perspective view of an outlet airflow direction control unit according to a fourth embodiment of the present invention.
Figure 19:
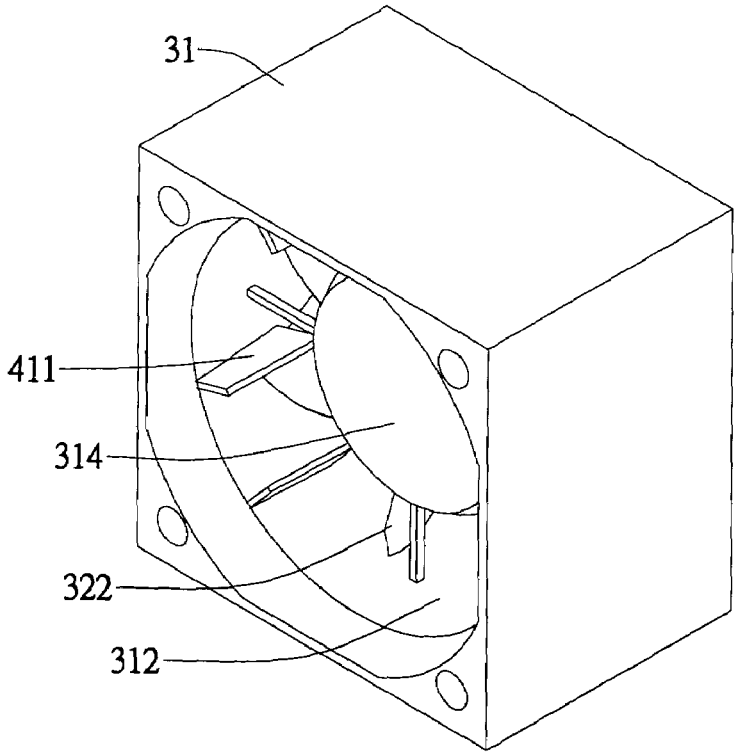
FIG. 19 is a front assembled perspective view of the outlet airflow direction control unit of FIG. 18.

Please now refer to FIGS. 18, 19, and 20 in which an outlet airflow direction control unit according to a fourth embodiment of the present invention is shown. As shown, the fourth embodiment is structurally and functionally similar to the third embodiment, except that the inlet 312 of the frame 31 of the fourth embodiment is formed on a peripheral wall thereof with a plurality of radially projected ribs 411 to change the radial pressure against the fluid flowing through the frame 31 and thereby control the flow direction of the fluid at the outlet 313.

The present invention has been described with some preferred embodiments thereof and it is understood that many changes and modifications in the described embodiments can be carried out without departing from the scope and the spirit of the invention as defined by the appended claims.

What is claimed is:

1. An outlet airflow direction control unit, comprising:

a frame having an inner peripheral wall defining an air passageway having an inlet and an outlet;

a plurality of radially projected fluid control elements each having an outer edge fixed to said peripheral wall at said outlet and a free inner edge;

a fan being supported in said frame;

wherein said fluid control elements are arranged and configured so that a fluid flowing out from said outlet is directed to flow radially inward; and wherein said fan includes a hub, and said fluid control elements are arranged and configured to direct said fluid radially inward behind the hub when flowing out of the outlet.

2. The outlet airflow direction control unit as claimed in claim 1, wherein said fluid control elements are control blades.

3. The outlet airflow direction control unit of claim 2, wherein said control blades are configured as one of T-shaped, L-shaped, and reverse L-shaped.

4. The outlet airflow direction control unit as claimed in claim 1, wherein said fluid control elements are ribs.

* * * * *